US007735537B2

(12) United States Patent
Hardt, II et al.

(10) Patent No.: US 7,735,537 B2
(45) Date of Patent: Jun. 15, 2010

(54) PORTABLE WALL-PARTITION

(76) Inventors: John C. Hardt, II, 1930 N. Wheat Rd., Belton, TX (US) 76513; Greg Moore, 62 S. Cliffwood, Morgans Point, TX (US) 76513; Chao-Ken Chen, No. 15-1, Fu Kung Rd. Fu-Hsing Industrial Park, Chung Hua Hsein, Taiwan (CN)

( * ) Notice: Subject to any disclaimer, the term of this patent is extended or adjusted under 35 U.S.C. 154(b) by 0 days.

(21) Appl. No.: 12/155,471

(22) Filed: Jun. 4, 2008

(65) Prior Publication Data

US 2009/0000750 A1 Jan. 1, 2009

Related U.S. Application Data

(63) Continuation-in-part of application No. 11/546,309, filed on Oct. 12, 2006, now Pat. No. 7,584,776.

(51) Int. Cl.
*A47G 5/00* (2006.01)

(52) U.S. Cl. ..... 160/135; 16/44; 16/47

(58) Field of Classification Search ..... 160/135; 52/71, 238.1, 239; 16/329, 47, 34, 44, 23, 16/35 D, 18 R, 28, 29; 280/124.114, 86.1, 280/67, 124.11, 124.111, 685, 11.28; 248/435, 248/591, 582; 267/185, 193, 75, 67, 228, 267/173, 74

See application file for complete search history.

(56) References Cited

U.S. PATENT DOCUMENTS

| | | | | |
|---|---|---|---|---|
| 2,635,281 | A * | 4/1953 | Feldberg | 16/276 |
| 3,653,455 | A * | 4/1972 | Hetteen | 180/251 |
| 4,302,891 | A * | 12/1981 | Gulli | 36/7.8 |
| 4,351,538 | A * | 9/1982 | Berta | 280/11.26 |
| 6,892,784 | B2 * | 5/2005 | Maas | 160/135 |
| 7,213,632 | B1 * | 5/2007 | Goldstein et al. | 160/135 |
| 7,341,262 | B2 * | 3/2008 | Liu | 280/11.28 |
| 2008/0086964 | A1 * | 4/2008 | Hardt | 52/239 |

FOREIGN PATENT DOCUMENTS

EP 0528061 * 8/1991

* cited by examiner

*Primary Examiner*—Blair M. Johnson
(74) *Attorney, Agent, or Firm*—Jerald L. Meyer; Derek Richmond; Jiaxiao Zhang

(57) ABSTRACT

Disclosed is a portable wall-partition that includes a plurality of panels and at least one hinge that connects each of the plurality of panels to a neighboring panel. A foot is positioned on a lower edge of each of the plurality of panels. The foot includes a first extension and a second extension. Each of the extensions includes a distal end thereof. The first and the second extensions are connected to each other at a proximal end (opposite the end having a wheel) to form a vertex. The foot also includes a spring located at or near the vertex. The spring biases the first and the second extensions toward each other.

14 Claims, 15 Drawing Sheets

PORTABLE WALL-PARTITION

This application is a continuation-in-part application of U.S. patent application Ser. No. 11/546,309 filed on Oct. 12, 2006. This application is related to a freestanding portable wall-partition that is collapsible for easy storage.

FIELD OF THE INVENTION

Background

There are times when it is desired to divide large areas, such as rooms or halls, into smaller more private areas. One method of doing this is by the use of movable wall panels which are suspended from, and move on tracks attached to, the ceiling and/or floor. However, this method is relatively expensive and inflexible.

Another method of dividing large areas into smaller private areas is to use movable free-standing wall units. This method is relatively inexpensive and it permits the formation of areas of a wide variety of shapes; but the free standing wall units present storage and handling problems and do not allow complete flexibility in the placement of the wall units relative to obstructions such as walls and support posts.

Hinges are well known for connecting members that are to rotate or pivot with respect to each other. One of the members may or may not be stationary. Examples of members that pivot with respect to each other are wall panels and room partitions. Likewise, examples where one member stays stationary include doors, gates, lids and covers. The most commonly known hinge is generally referred to as the piano hinge. The piano hinge may be described as having flat or plate portions that are secured along the edges of the respective two members so that the members arc, thereby pivoting with respect to each other. The edges of the hinge plates of the piano hinge have fingers or tabs that are formed into a complete loop portion for capturing a pin or rod. The tabs extending from opposing plates are staggered to permit them to interleave and become aligned with opposing tabs. The aligned looped tabs permit the pin or rod to be captured by the tabs and permit the hinge plates to pivot or rotate with respect to each other.

Piano hinges, though, have two significant drawbacks: they typically do not permit 360° articulation with respect to the two members, but most commonly allow 180° articulation; and they align the edges of the members closely together and, as a consequence, renders them prone to pinching fingers or other objects that happen to get placed in the vicinity of the hinge during such pivotal movement. This is largely because both hinge plate portions are close together and both pivot about a single axis.

SUMMARY OF THE INVENTIVE ASPECTS

An embodiment of the portable wall-partition includes a wall panel that has a first edge and a second edge. The second edge is transversely connected to the first edge, which means that the two edges can be relatively perpendicular to each other; however, the edges are not limited to such a configuration. Also included in this embodiment is a swivel wheel mechanism that is connected to a central position of the first edge. At least one end panel having an intermediate portion is connected via a hinged connection at its intermediate portion to the second edge of the wall panel. The swivel wheel mechanism includes at least one arm that is supported by at least one caster positioned at a first end of the arm. The arm is rotatable about an axis, and the axis is defined by the central position of the first edge of the wall panel.

The wall-partition of this embodiment can include at least one additional wall panel and a bracket connecting the first wall panel to the additional wall panel. A second end panel can be connected to an end of the wall-partition that is opposite that of the first end panel, thereby providing greater stability for longer wall-partitions. Further, in longer room wall-partitions, intermediate panels can be inserted between particular panels in a perpendicular fashion to provide greater stability to the overall wall-partition. Lastly, a hinged connection, like a piano hinge, or a geared hinge, can be added in place of the bracket between the second end panel and the additional wall panel.

Another embodiment of the portable wall-partition includes a plurality of wall panels that can be made of a singular construction to reduce manufacturing costs. Each of the plurality of wall panels has a lower edge, which is shaped depending on the needs of the user. For example, an oval panel will have a lower edge that is curved, while a rectangular panel will have a lower edge that is relatively straight. The panel will thus also have a transverse side edge that is shaped depending on the needs of the user. Each of the plurality of panels is preferably attached to a successive panel at the transverse side edge.

This embodiment of the wall-partition further includes a swivelable elongate wheel frame that is connected at its midpoint to a midpoint of the lower edge. A first wheel is connected to a first end of the elongate wheel frame, and a second wheel is connected to a second end of the elongate wheel frame. The plurality of panels should be substantially identical to each other in the placement of the swivelable elongate wheel frame on the lower edge of the panel. The remainder of each panel can be any shape that the user desires.

Additionally, in this embodiment, the wall-partition can also include a first skewed end panel that is connected at a first planar surface thereof to a first end panel of the plurality of wall panels. In this configuration, the skewed end panel is not necessarily limited to an orientation perpendicular to the first end panel, but is preferably oriented in such a way that it is not parallel with the first end panel. Thus, the skewed end panel serves to provide added stability for the entire portable wall-partition. Further, a second skewed end panel that has a second planar surface can be connected at its second planar surface to a second end panel of the plurality of wall panels.

Also, each of the plurality of panels in this embodiment can further comprise a plurality of sound absorbing ribs on its respective surfaces. Similarly, the first skewed end panel and the second skewed end panel can include a plurality of sound absorbing ribs on their surfaces. A bracket or hinge can be used to connect each of the wall panels to its adjoining wall panel so that the panels are allowed to collapse into a folded configuration.

A further embodiment of the portable wall-partition includes a first wall panel and a second wall panel. The first and second wall panels both have a wheeled swivel bracket that is longitudinally connected to a bottom edge of each of the wall panel. A bracket hinge connects the first wall panel to the second wall panel. A linkage connects the bracket hinge to the swivel wheel mechanism so that the swivel wheel mechanism of the first and of the second wall panels extends toward a position perpendicular to that of the first and the second wall panels. The linkage can be a four-bar linkage or a belt linkage.

Variations of this embodiment of the wall-partition can include a bracket hinge gear, which extends from an axis of rotation of the bracket hinge into the first wall panel. Alternatively, a swivel wheel mechanism gear can be used rather than the bracket hinge gear and can similarly extend from an axis of rotation of the swivel wheel mechanism into the first wall panel. The linkage between the bracket hinge gear and the swivel mechanism gear can be a chain linkage or a belt linkage.

This embodiment can also include a first end panel that is substantially perpendicularly connected to the first wall panel using a first end panel hinge. Similarly, a second end panel can be connected to the second wall panel using a second end panel hinge. The first end panel and the second end panel should each include at least one caster on a bottom edge thereof, however, casters are not necessary. Lastly, each of the panels of this embodiment of the wall-partition can include a plurality of sound absorbing ribs.

Alternative embodiments of the wall partition include a plurality of panels and at least one hinge that connects each of the plurality of panels to an adjoining panel. A foot is positioned on a lower edge of each of the plurality of panels. The foot includes a first extension and a second extension. Each of the extensions includes a distal end having a wheel. The first and the second extensions are connected to each other at a proximal end (opposite the distal end) to form a vertex. The foot also includes a spring located at or near the vertex. The spring biases the first and the second extensions toward each other.

Variations of this embodiment of the wall partition are configured such that the hinge is comprised of a first arm and a second arm. Each of the first arm and the second arm has a semicircular-shaped end. A spring is positioned along a hinge-axis such that a spring-axis of the spring is parallel with the hinge axis. The hinge-axis extends through a center point of both the first and second arms. The semicircular-shaped end of the first arm can be separated from the semicircular-shaped end of the second arm by a plurality of ball-bearings. The semicircular-shaped end can optionally include a plurality of recesses that engageably correspond to the plurality of ball-bearings such that both the plurality of recesses and the plurality of ball-bearings are about equidistant from the axis of the hinge.

Further variations of the wall partition include removable panels, i.e., each of the plurality of panels is removable and replaceable by other panels. One of the many benefits to making the panels removable is that any of the panels can be replaced with a desired surface such as a white board, a black board, a cork board, or a tack board. Also, the plurality of panels can include a sound dampening panel, which can be made of sound absorbing ribs in a first surface of the panel.

A person having ordinary skill in the art will understand that features from each of the embodiments that are not present in the other embodiments can be added to those embodiments missing the respective features.

DETAILED DESCRIPTION

The word "exemplary" is used herein to mean "serving as an example, instance, or illustration." Any embodiment described herein as "exemplary" is not necessarily to be construed as preferred or advantageous over other embodiments.

Figure 1:
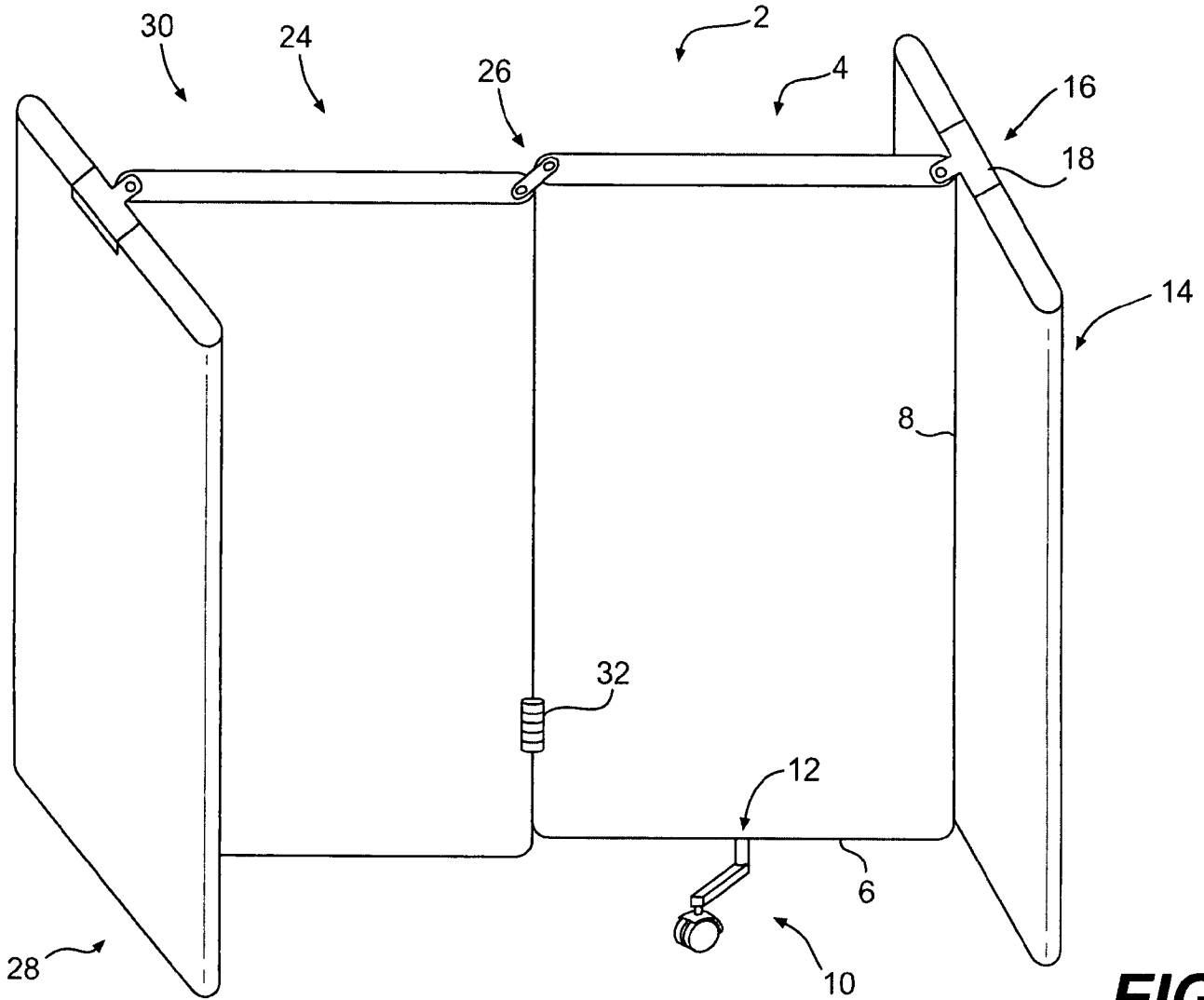
FIG. 1 shows an embodiment of the portable wall-partition.

An embodiment of the portable wall-partition 2 is shown in FIG. 1. This embodiment includes at least one wall panel 4 that has a first edge 6 and a second edge 8. The second edge 8 is transversely connected to the first edge 6, which means that the two edges can be relatively perpendicular to each other; however, the edges are not limited to such a configuration. Also included in this embodiment is a swivel wheel mechanism 10 that is connected to a central position 12 of the first edge 6. At least one end panel 14 having an intermediate portion 16 is connected via a hinged connection 18 at its intermediate portion 16 to the second edge 8 of the wall panel 4.

Figure 2:
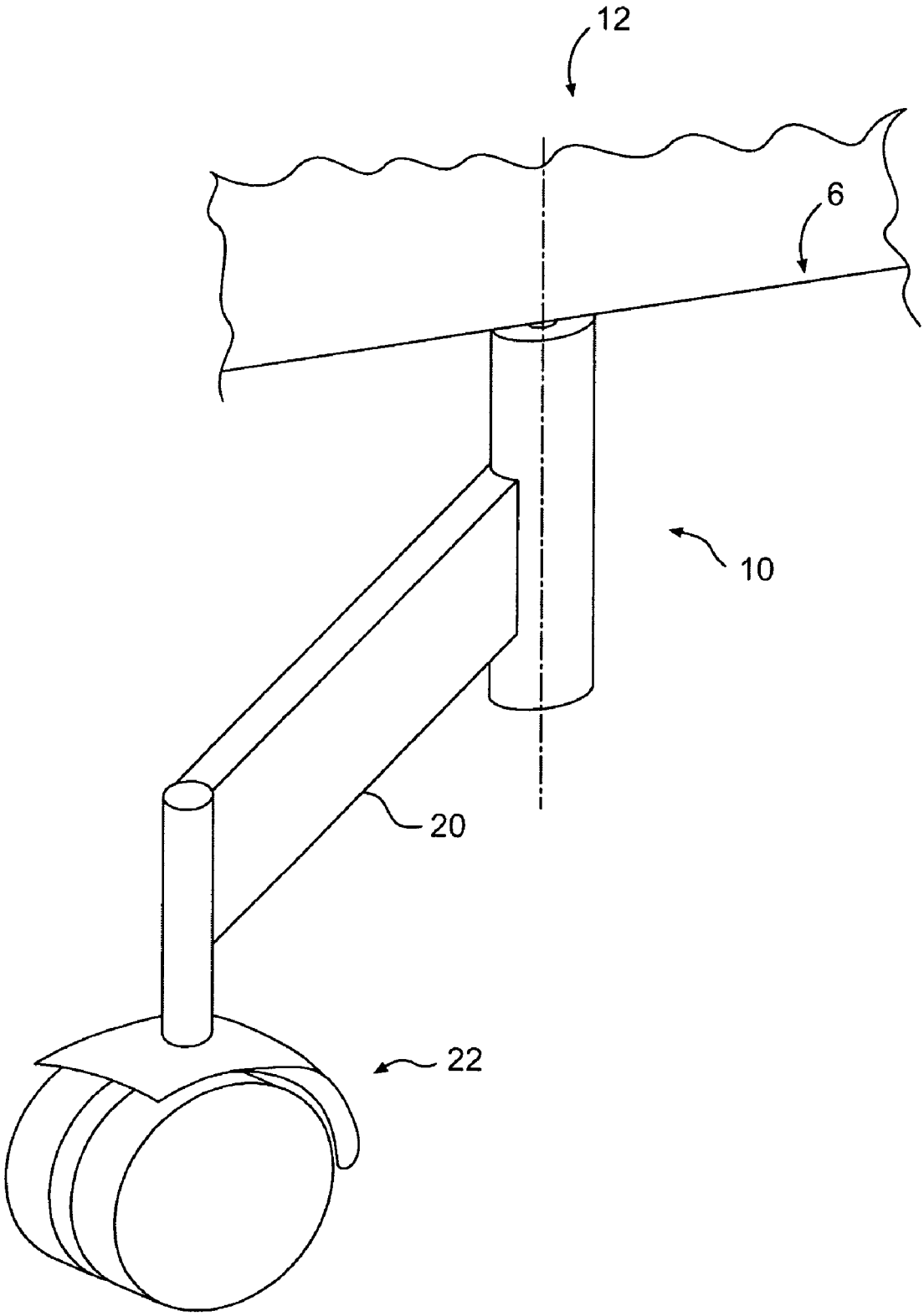
FIG. 2 shows a swivel wheel mechanism of the embodiment of the portable wall-partition of FIG. 1.

As shown with more particularity in FIG. 2, the swivel wheel mechanism 10 includes an arm 20 supported by at least one caster 22 positioned at a first end of the arm 20, the arm 20 is rotatable about an axis, which is defined by the central position 12 of the first edge 6 of the wall panel 4.

Additionally, with further reference to FIG. 1, this embodiment can include at least one additional wall panel 24 and an additional bracket 26 connecting the first wall panel 4 to the additional wall panel 24. Also, a second end panel 28 can be connected to an end 30 of the portable wall-partition 2 that is opposite that of the first end panel 4, thereby providing greater stability for longer portable wall-partitions, i.e., partitions with more than two wall panels. Lastly, a double hinged connection 32 can be added in place of the bracket between the second end panel and the additional wall panel. Non-limiting examples of usable double hinged connections include a piano hinge or a geared hinge. When using a piano hinge or a geared hinge, the hinge should have two axes of rotation. For example, when using a piano hinge, the hinge should include three brackets. The first bracket of the piano hinge attaches to a wall panel, an intermediate (second) bracket of the piano hinge connects the first bracket of the piano hinge to the third bracket of the piano hinge; and the third bracket of the piano hinge attaches to an adjacent wall panel.

Alternatively, while the embodiment of FIG. 1 shows two wall panels, it is contemplated within the scope of this embodiment that further additional wall panels may be included in the wall partition. A skilled artisan will recognize that each additional wall panel will be interconnected in a likewise manner as discussed above.

Figure 3:
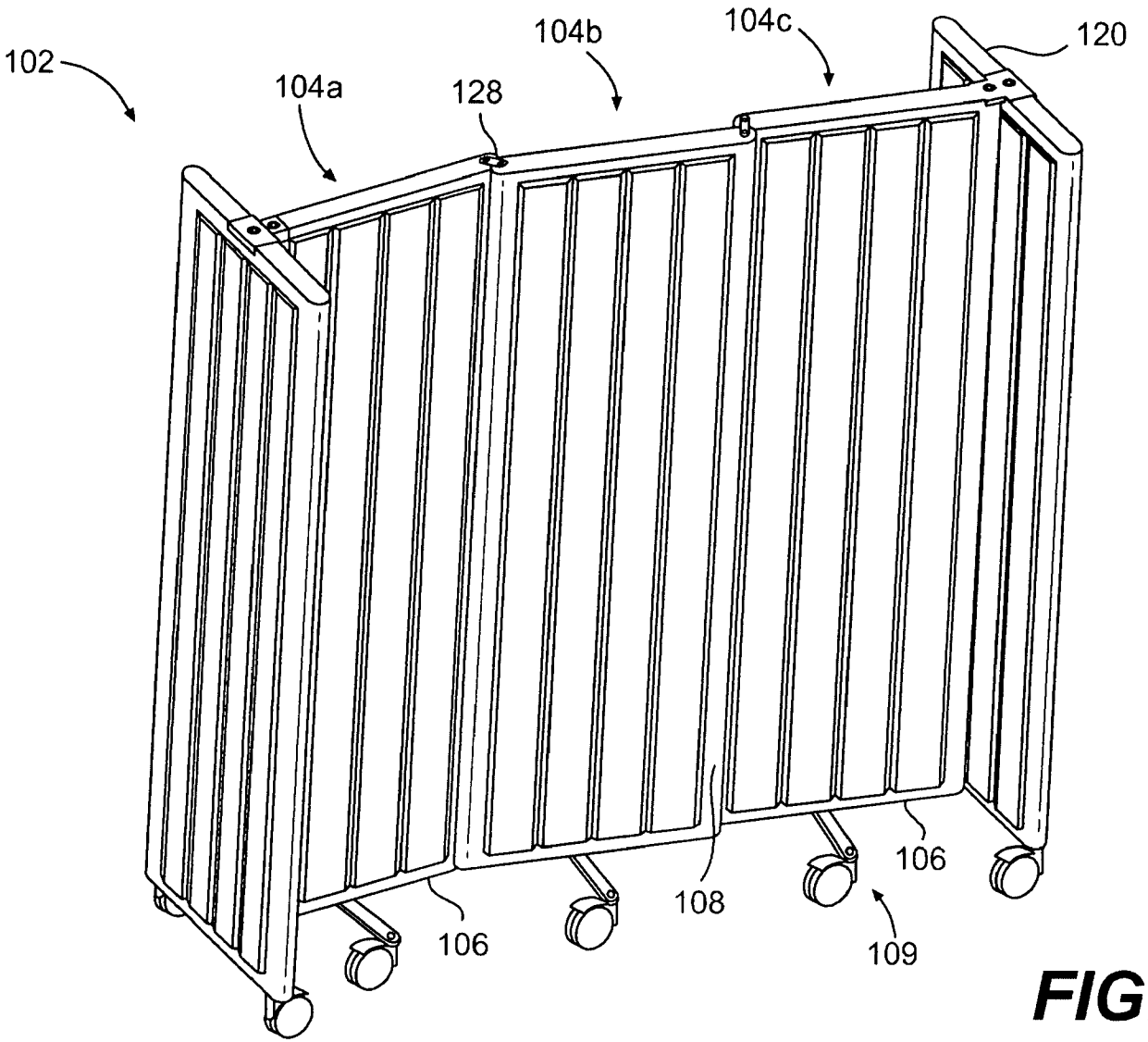
FIG. 3 shows another embodiment of the portable wall-partition.
Figure 4:
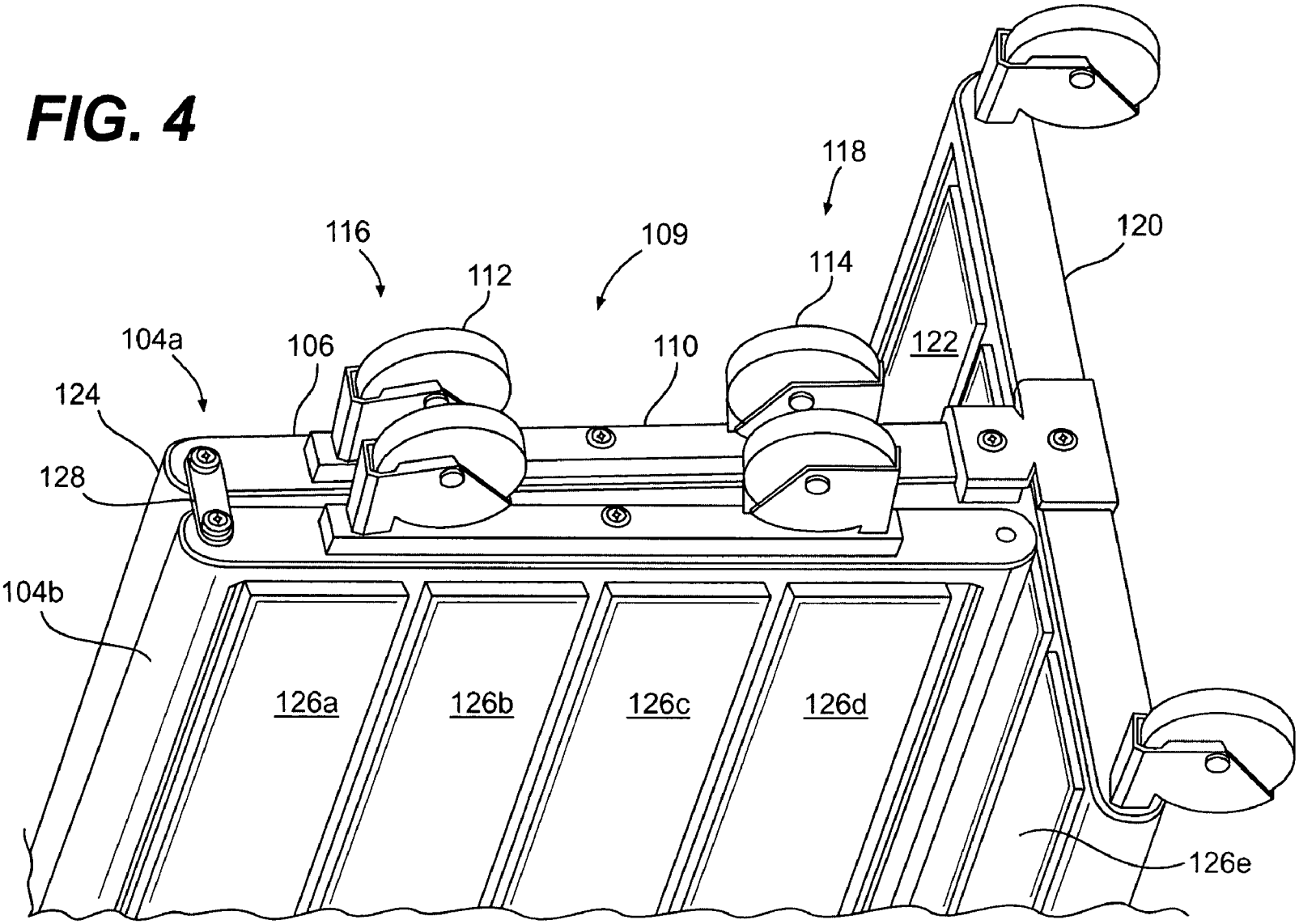
FIG. 4 shows a bottom view of the embodiment of the portable wall-partition shown in FIG. 3.

A second embodiment 102 of the portable wall-partition is shown in FIGS. 3 and 4 and includes a plurality of wall panels 104*a*, 104*b*, and 104*c* that can be made of a singular construction to reduce manufacturing costs. Each of the plurality of wall panels has a lower edge 106, which is shaped depending on the needs of the user. Each panel also has a transverse side edge 108 that is shaped depending on the needs of the user. Each of the plurality of panels is attached to a successive panel at the respective transverse edge 108. Each of the plurality of panels includes a wheel assembly 109 that includes a swivelable elongate wheel frame 110 that is connected at its midpoint to a midpoint of the lower edge 106. A first wheel 112 is connected to a first end 116 of the elongate wheel frame 110, and a second wheel 114 is connected to a second end 118 of the elongate wheel frame 110.

The elongate wheel frame 110 is swivelable to a position substantially perpendicular to the longitudinal axis of each of the plurality of wall panels. When stored, the elongate wheel frame 110 is repositioned to a configuration that is parallel to the longitudinal axis of each of the plurality of wall panels.

With further reference to FIGS. 3 and 4, this embodiment of the portable wall-partition 102 also includes a first skewed end panel 120 that is connected at a first planar surface 122 thereof to a first end panel 124 of the plurality of wall panels. The skewed end panel 120 is not necessarily limited to an orientation perpendicular to the wall panel, but is preferably oriented in such a way that it is not parallel with the first end panel 124. In this manner, the first skewed end panel 120 serves to provide added stability for the entire portable wall-partition 102. With similarity to the embodiment of FIG. 1, a second skewed end panel can be connected to a second end panel of the plurality of wall panels.

Also, each of the plurality of panels 104*a*-104*c* in this embodiment includes a plurality of sound absorbing ribs. The sound absorbing ribs 126*a*, 126*b*, 126*c*, and 126*d* are placed either on the surface of the wall panel or within the wall panel and covered by a fabric or other material that lets sound pass through to the sound absorbing ribs. Similarly, the first skewed end panel 120 (and the second skewed end panel) includes a plurality of sound absorbing ribs 126*e* in its surface. Lastly, a bracket 128 (or hinge) connects each of the wall panels to an adjoining wall panel so that the panels are allowed to collapse into a folded configuration. The bracket 128 is placed at either the top of the wall panel, at the bottom of the wall panel or at both the top and the bottom of the wall panel.

Figure 5:
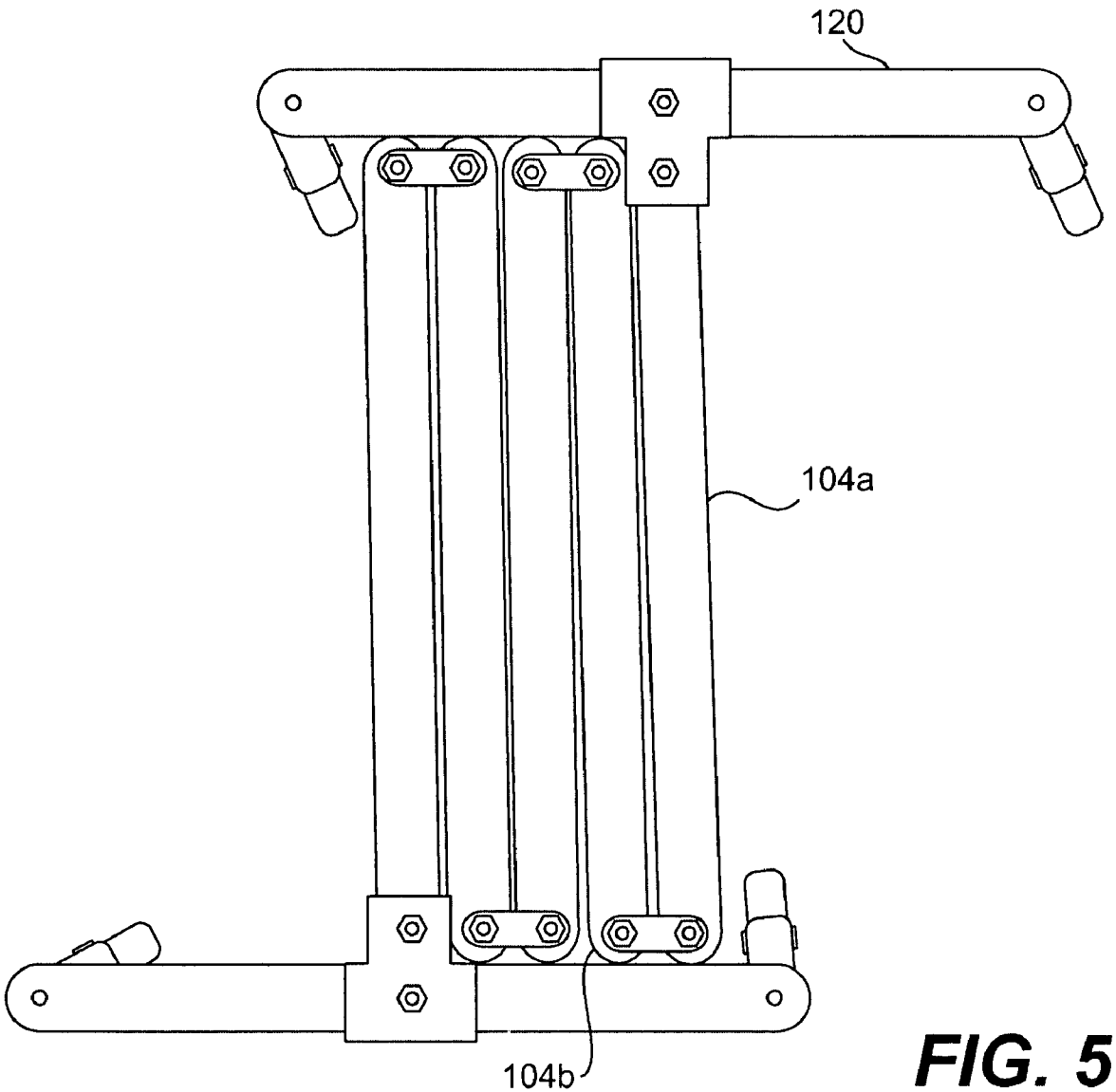
FIG. 5 shows a top view of the embodiment of the portable wall-partition of FIG. 3 in a folded configuration.

When not in use, the plurality of wall panels can be folded so that one panel 104*a* lies flat against an adjoining panel 104*b*. FIG. 5 shows a top view of the plurality of wall panels in a folded configuration.

Figure 6:
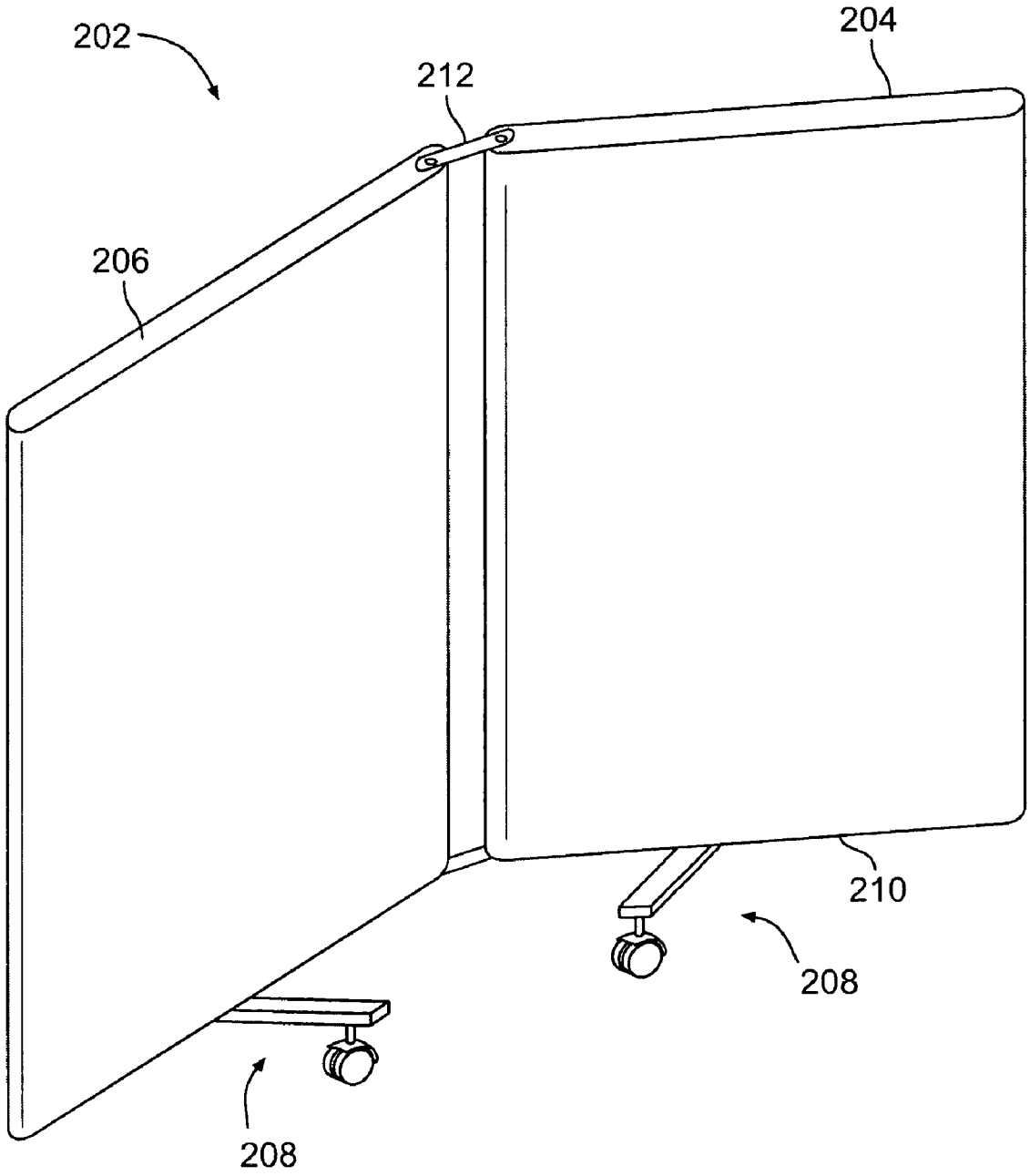
FIG. 6 shows a perspective view of a further embodiment of the portable wall-partition.

As shown in FIG. 6, a further embodiment of the portable wall-partition 202 includes a first wall panel 204 and a second wall panel 206. The first and second wall panels 204 and 206 each include a swivel wheel mechanism 208 that is longitudinally connected to a bottom edge 210 of each of the wall panels 204 and 206. A bracket hinge 212 connects the first wall panel 204 to the second wall panel 206.

Figure 7:
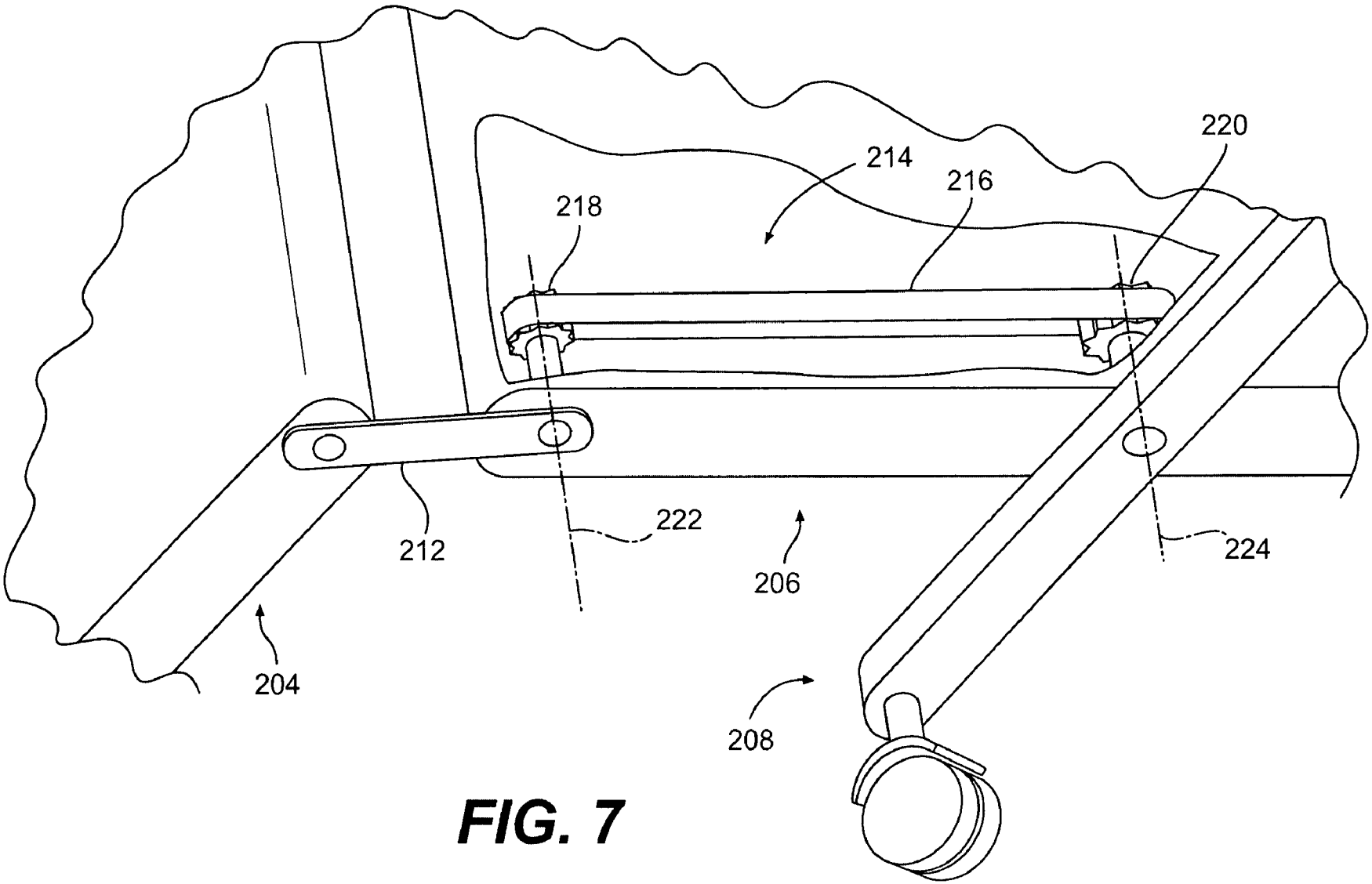
FIG. 7 shows a belt and gear mechanism in an interior view of the embodiment of the portable wall-partition of FIG. 6.
Figure 8:
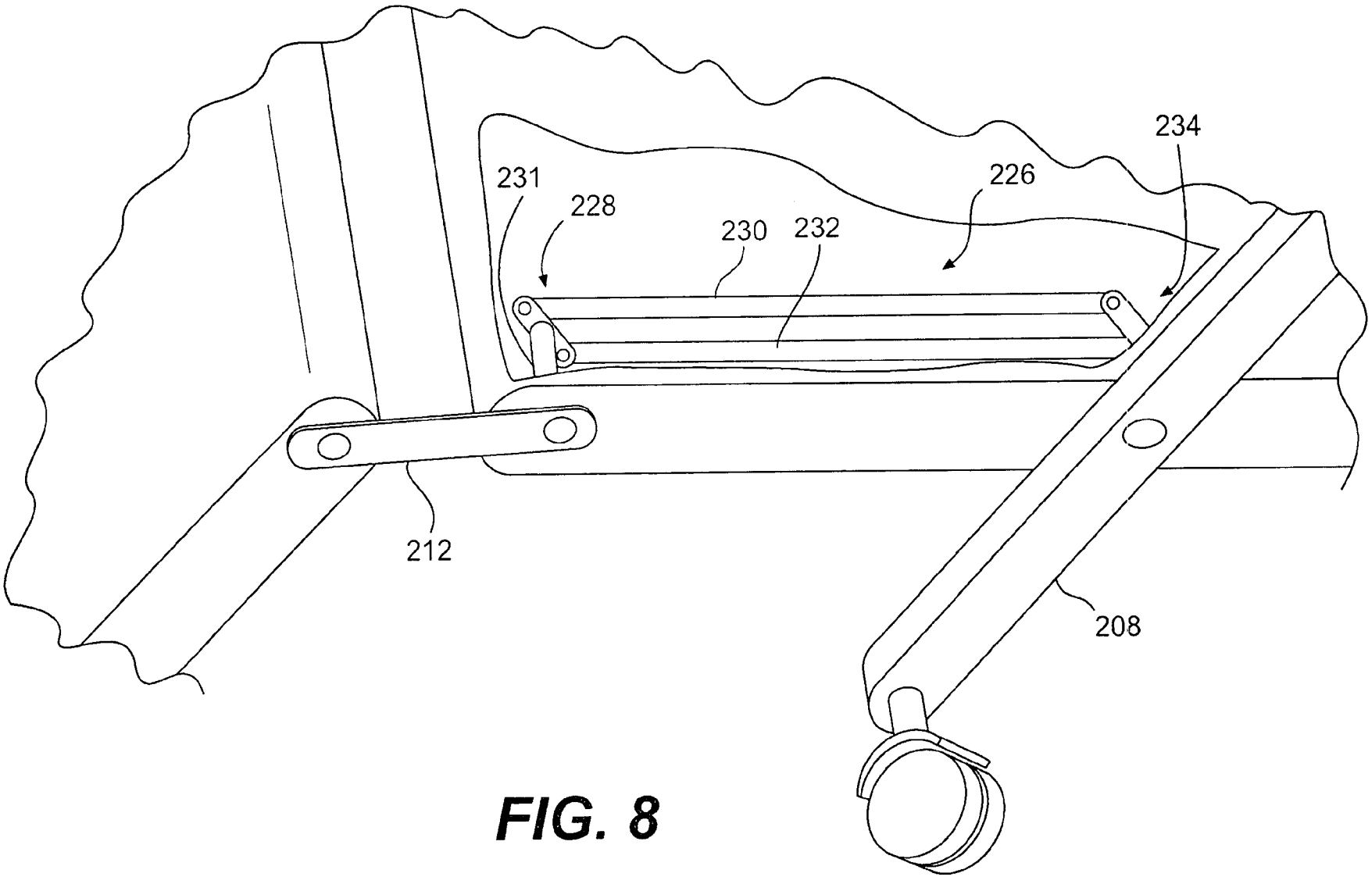
FIG. 8 shows a four-bar linkage in an interior view of the embodiment of the portable wall-partition of FIG. 6.

As can be seen in FIGS. 7 and 8, the interior of the first and the second wall panels 204 and 206 includes a linkage 214 that connects the bracket hinge 212 to the swivel wheel mechanism 208 so that the swivel wheel mechanism 208 of the first and second wall panels 204 and 206 extends toward a position perpendicular to that of the first and the second wall panels.

The linkage 214 can be a chain linkage or a belt linkage. FIG. 7 shows the linkage with a belt 216. Alternatively, however, a chain similar to that used in a bicycle can be used with a gear. The belt 216 wraps around a first gear 218, which is coaxial with an axis of rotation 222 of the bracket hinge 212, and second gear 220, which is coaxial with an axis of rotation 224 of the swivel wheel mechanism 208. When a person unfolds the portable wall-partition 202, the first gear 218 rotates. This rotation causes the belt 216 to rotate, thus causing the second gear 220 to rotate, thereby rotating the swivel wheel mechanism 208. Therefore, the swivel wheel mechanism extends or retracts based on the configuration of the wall panels 204 and 206 with respect to one another. Also, this embodiment is not limited to two wall panels but can also include a lesser or greater number of wall panels all similarly configured or configured differently based on the desires of the user.

A four-bar linkage 226 shown in FIG. 8 can be used in place of a belt or chain linkage. The four-bar linkage 226 has a frame 228 that is shaped like a "T." The frame has a post 231 that is coaxial with an axis of rotation of the bracket hinge 212. An upper, horizontal section of the frame 228 is connected at a first end to a first rocker arm 230 and at a second end to a second rocker arm 232. A crank 234 is positioned coaxially with an axis of rotation of the swivel wheel mechanism 208. Each rocker arm 230 and 232 extends from the frame 228 and connects to opposing ends of the crank 234. Thus, when the frame is rotated by opening the wall panels 204 and 206, the rocker arms 230 and 232 will rotate the crank 234 thereby causing the swivel wheel mechanism 208 to rotate to an extended or a concealed configuration, depending on the direction of rotation.

Figure 9:
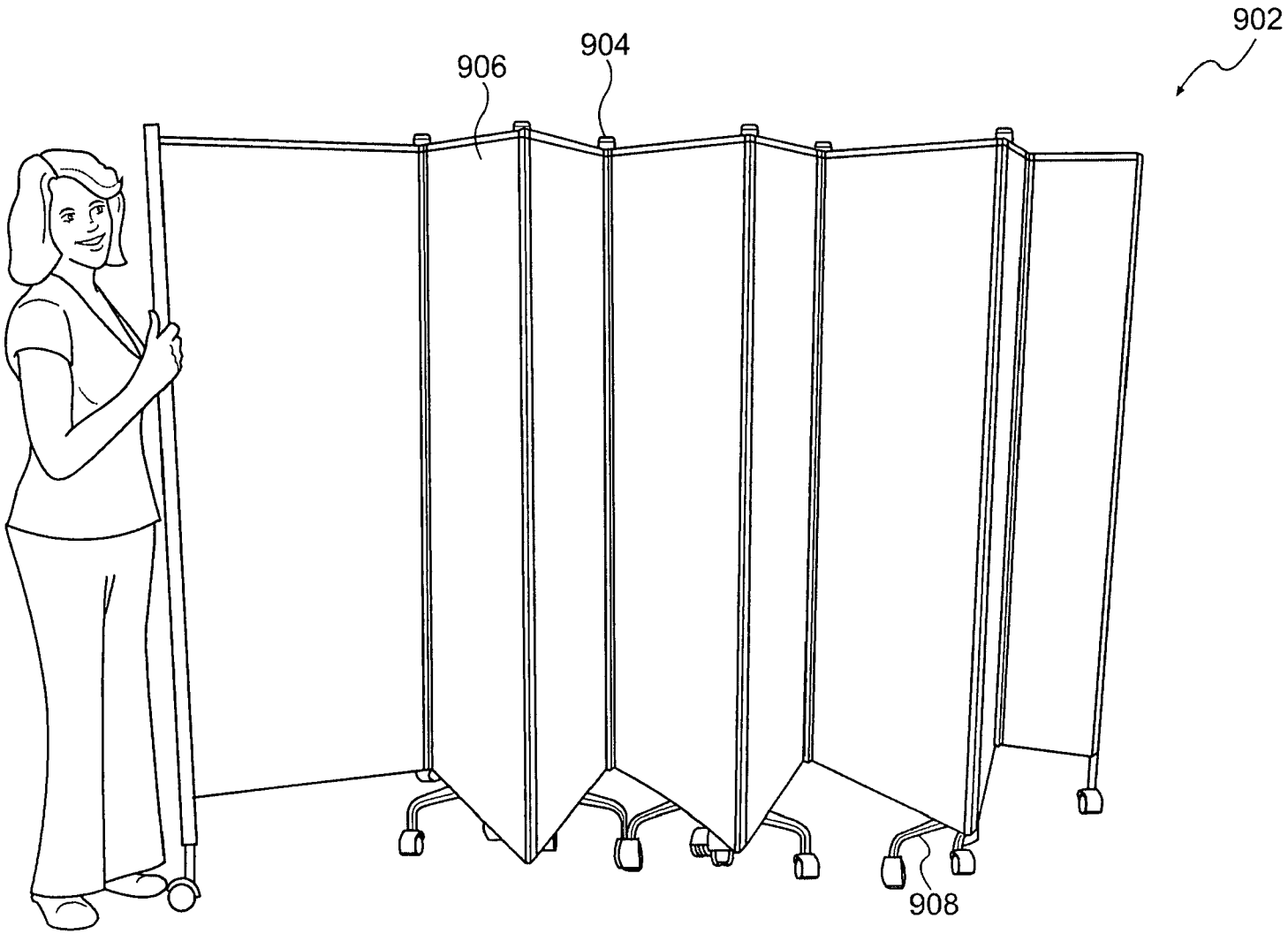
FIG. 9 shows a plurality of interchangeable wall panels.
Figure 10:
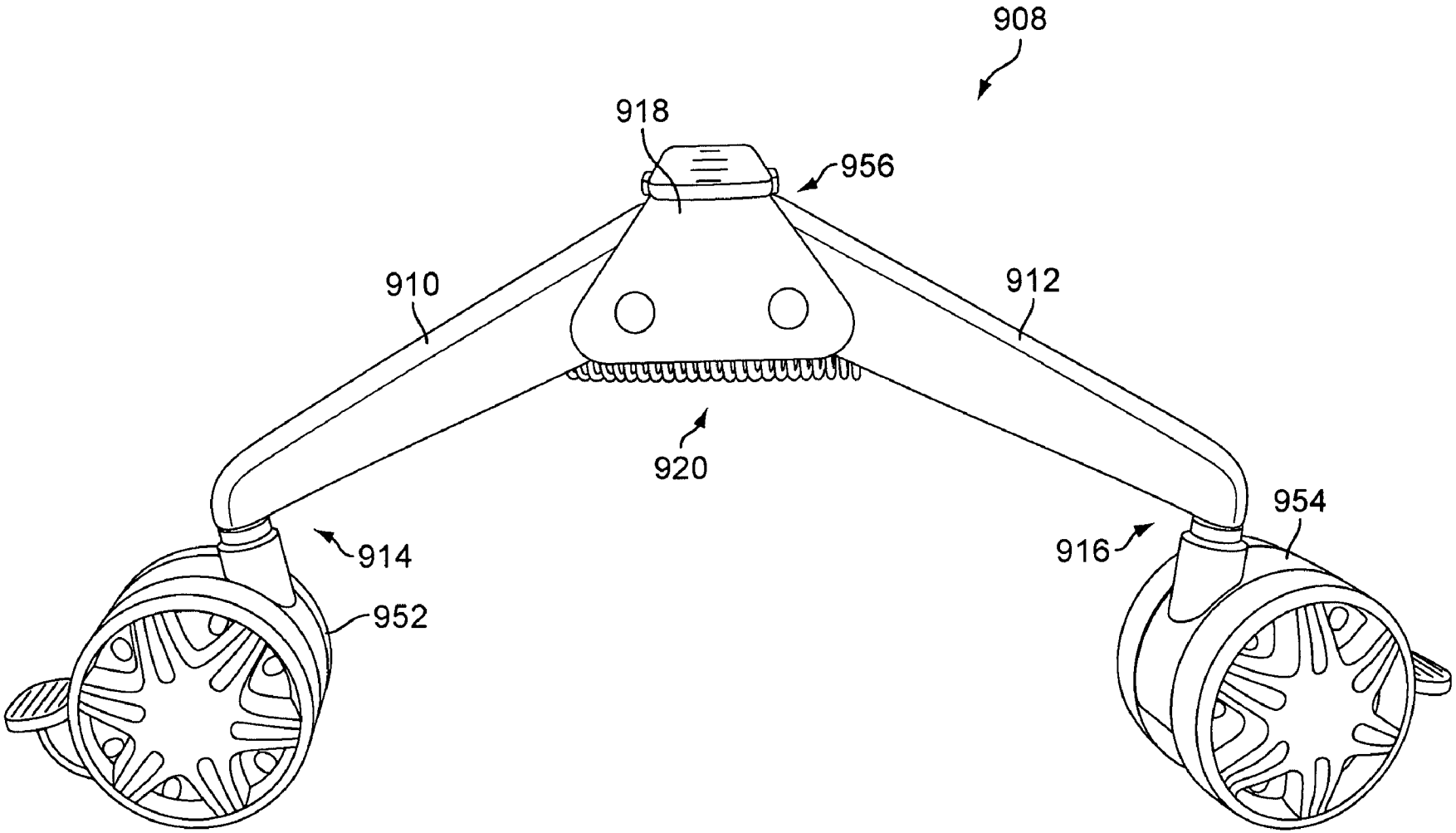
FIG. 10 shows a foot of the interchangeable wall panels.
Figure 11A:
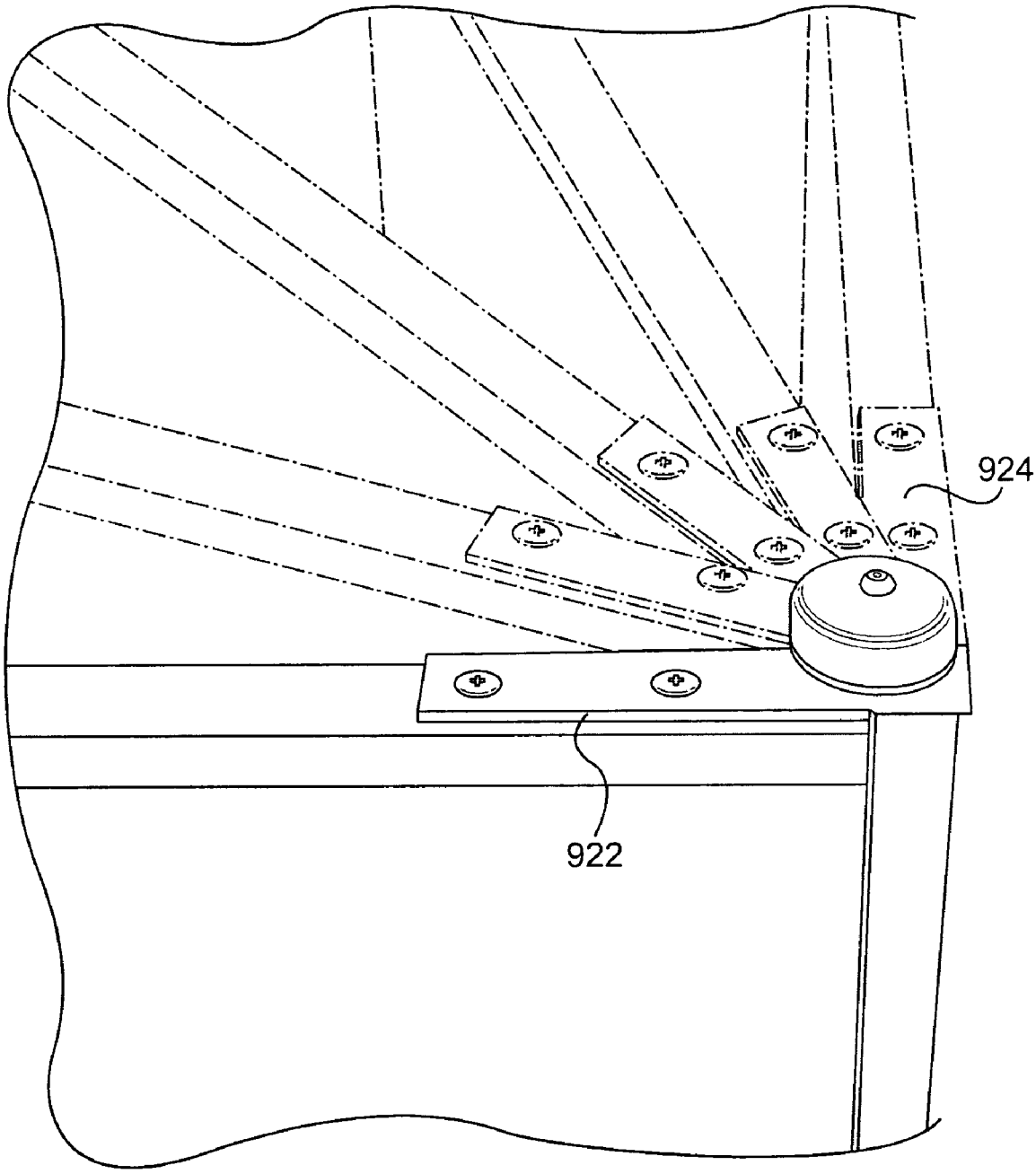
FIG. 11*a* shows a hinge attached to panel in various positions of operation.
Figure 11B:
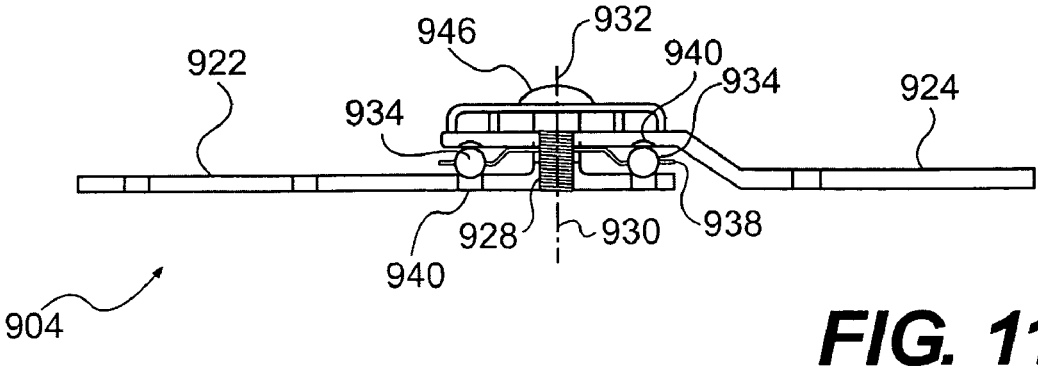
FIG. 11*b* shows a side view of the hinge of FIG. 11*a;*
Figure 11C:
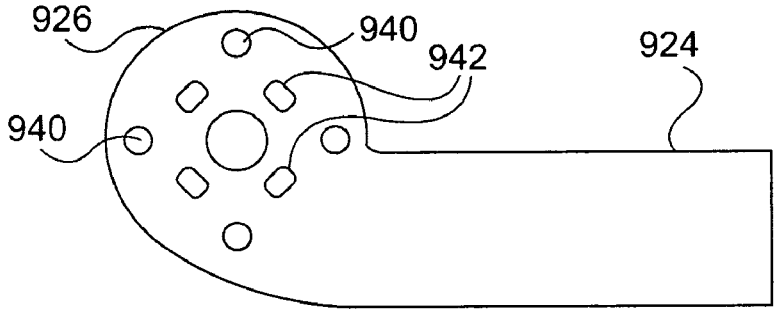
FIG. 11*c* shows an arm of the hinge of FIG. 11*a;*
Figure 11D:
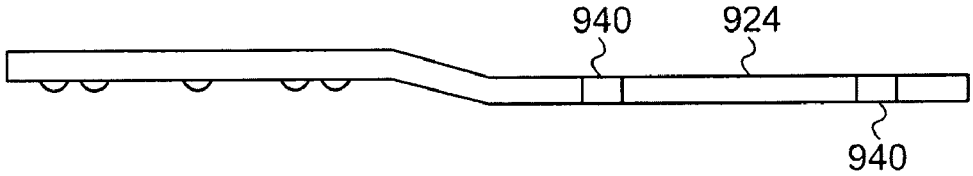
FIG. 11*d* shows a side view of the arm of FIG. 11*c;*
Figure 11E:
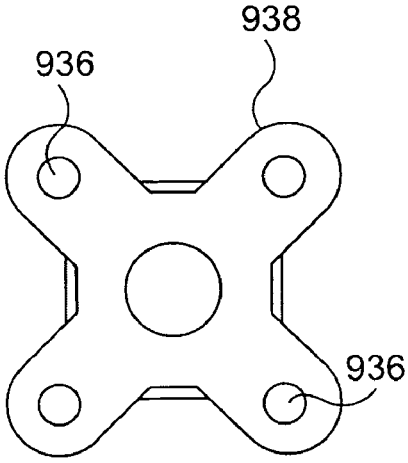
FIG. 11*e* shows a cradle for the hinge of FIG. 11*b;*
Figure 11F:
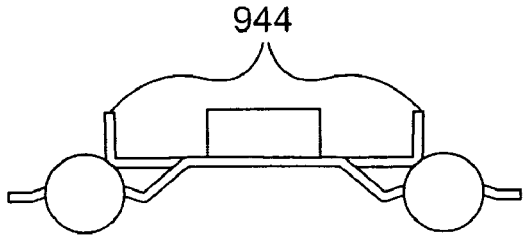
FIG. 11*f* shows a side view of the cradle of FIG. 11*e;*

With reference to FIG. 9, an alternative embodiment of the wall partition includes a plurality of panels 902 and at least one hinge 904 that connects each panel 906 of the plurality of panels 902 to a adjoining panel. A foot 908 is positioned on a lower edge of each of the plurality of panels 904. As shown in FIG. 10, the foot 908 includes a first extension 910 and a second extension 912. Each of the extensions 910 and 912 includes a distal end 914 and 916, respectively. The first and the second extensions 910 and 912 are connected to each other at a proximal end 956 (opposite the distal ends 914 and 916) to form a vertex 918. The foot 908 also includes a spring 920 located at or near the vertex 918. The spring 920 biases the first extension 910 toward the second extension 912 and vice versa.

One of the benefits of the foot is that it provides more stability for the plurality of panels 902 when the plurality of panels 902 is on an uneven floor. For example, if the wheel 952 of the first extension 910 is resting on a surface that is somewhat lower than the wheel 954 of the second extension 912, the spring will pull the first extension 910 toward the second extension 912 to maintain contact between the wheels of both extensions and the floor.

With reference to FIGS. 11*a*, 11*b*, 11*c*, 11*d*, 11*e* and 11*f*, the hinge 904 is comprised of a first arm 922 and a second arm 924. Each of the first arm 922 and the second arm 924 has a semicircular-shaped end 926. A spring 928 is positioned along a hinge-axis 930 such that a spring-axis 932 of the spring 928 is parallel with the hinge axis 930. The hinge-axis 930 extends through a center point of both the semicircular-shaped end 926 of the first and second arms 922 and 924. The semicircular-shaped end 926 of the first arm 922 can be separated from the semicircular-shaped end of the second arm by a plurality of ball-bearings 934. The ball-bearings 934 rest in recesses 936 of cradle 938. The semicircular-shaped end 926 can optionally include a plurality of recesses or through-holes 940 that engageably correspond to the plurality of ball-bearings 934 such that both the plurality of recess 940 and the plurality of ball-bearings 934 are about equidistant from the axis 930 of the hinge 904.

The wall partition includes removable panels, i.e., each of the plurality of panels is removable and replaceable by other panels. To connect the arm 924 to the cradle 938, connection holes 942 are provided in the semicircular-shaped end 926. Connection holes 942 lockingly engage tabs 944 on cradle 938. A fastener 946 is then applied to the hinge axis 930. The fastener 946 provides easier interchangability of the plurality of panels 902 as one panel can be unfastened from an adjoining panel and replaced.

Figure 12A:
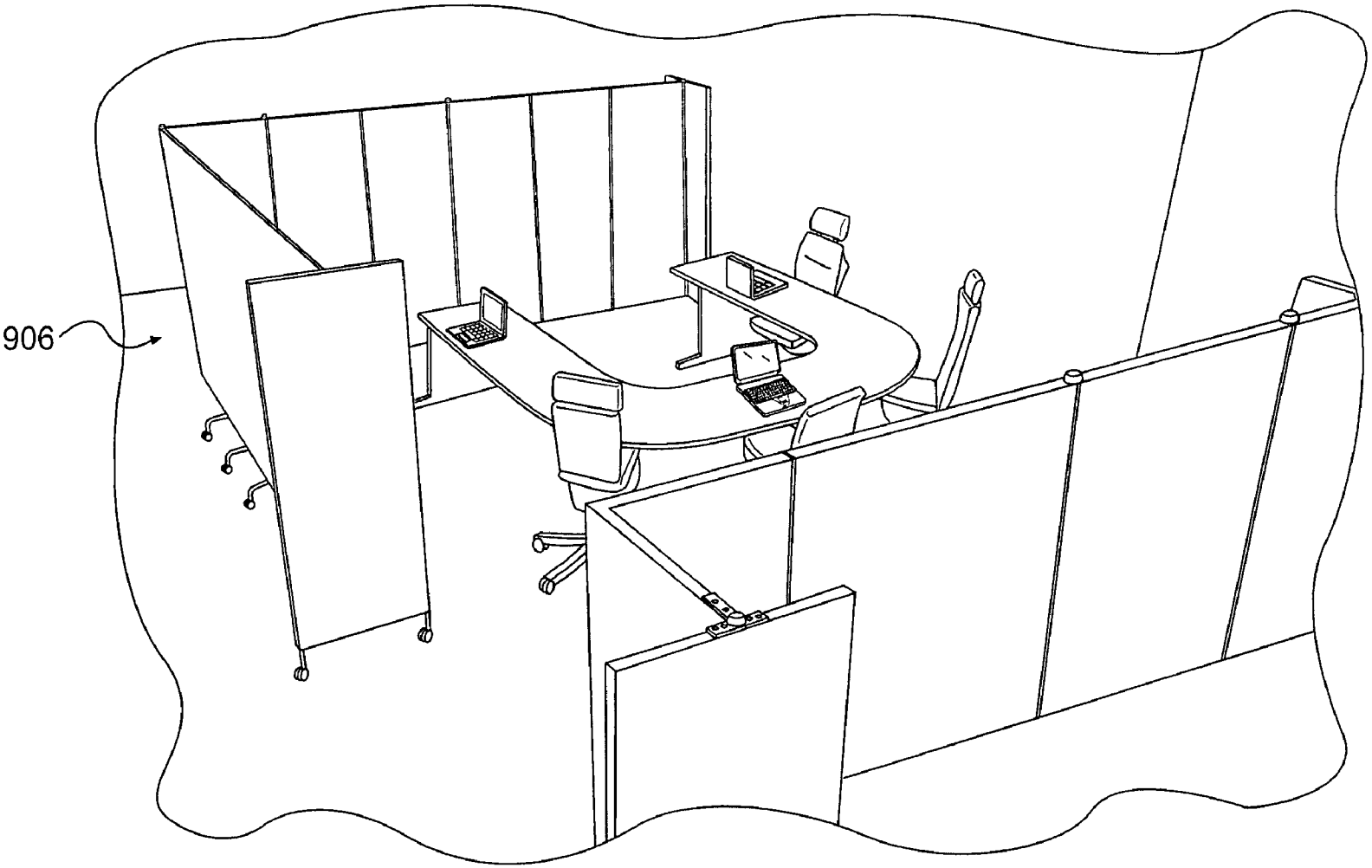
FIG. 12*a* shows a plurality of panels in an office setting.
Figure 12B:
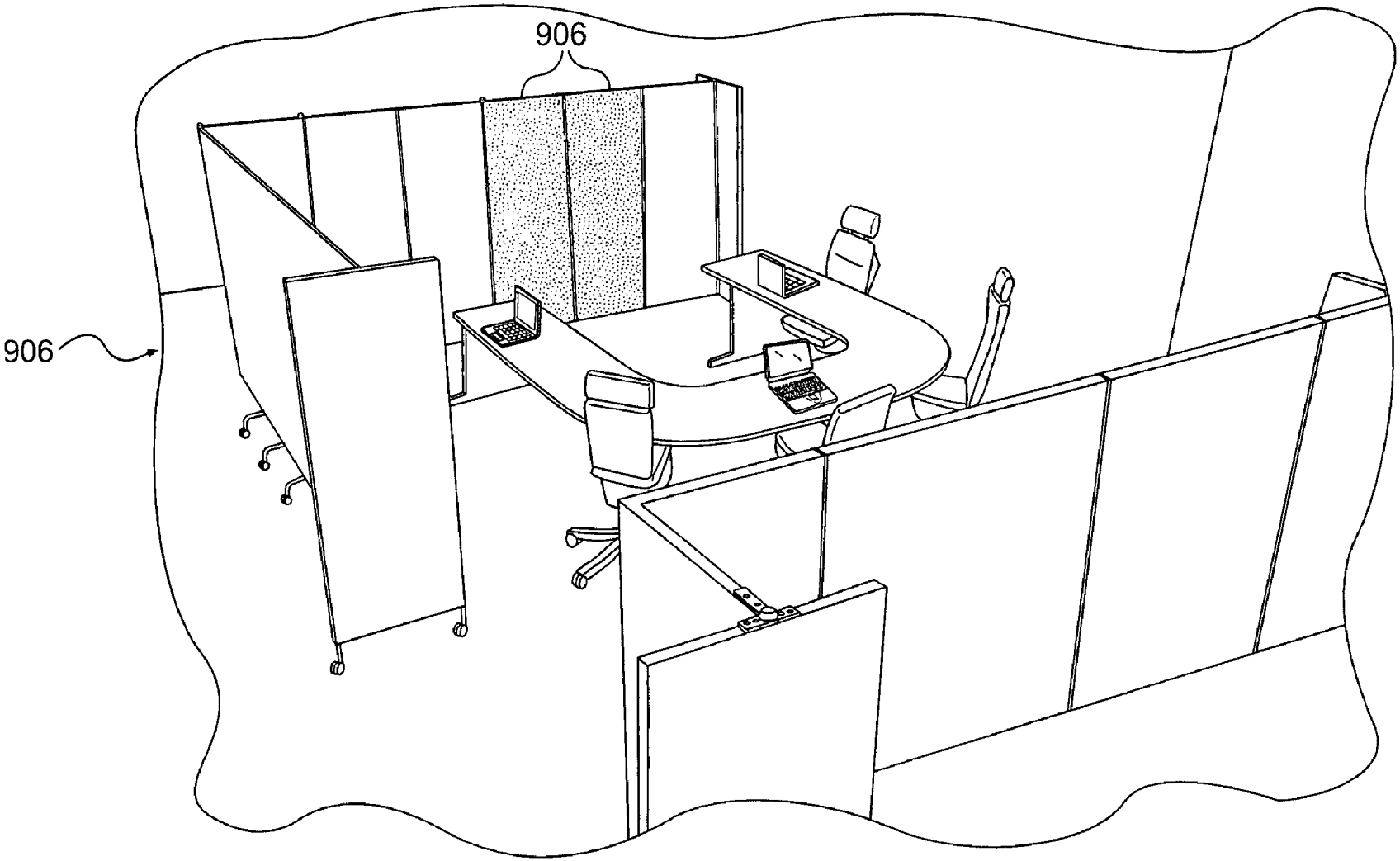
FIG. 12*b* shows a plurality of panels with some of the panels of FIG. 12*a* replaced with whiteboard panels.
Figure 12C:
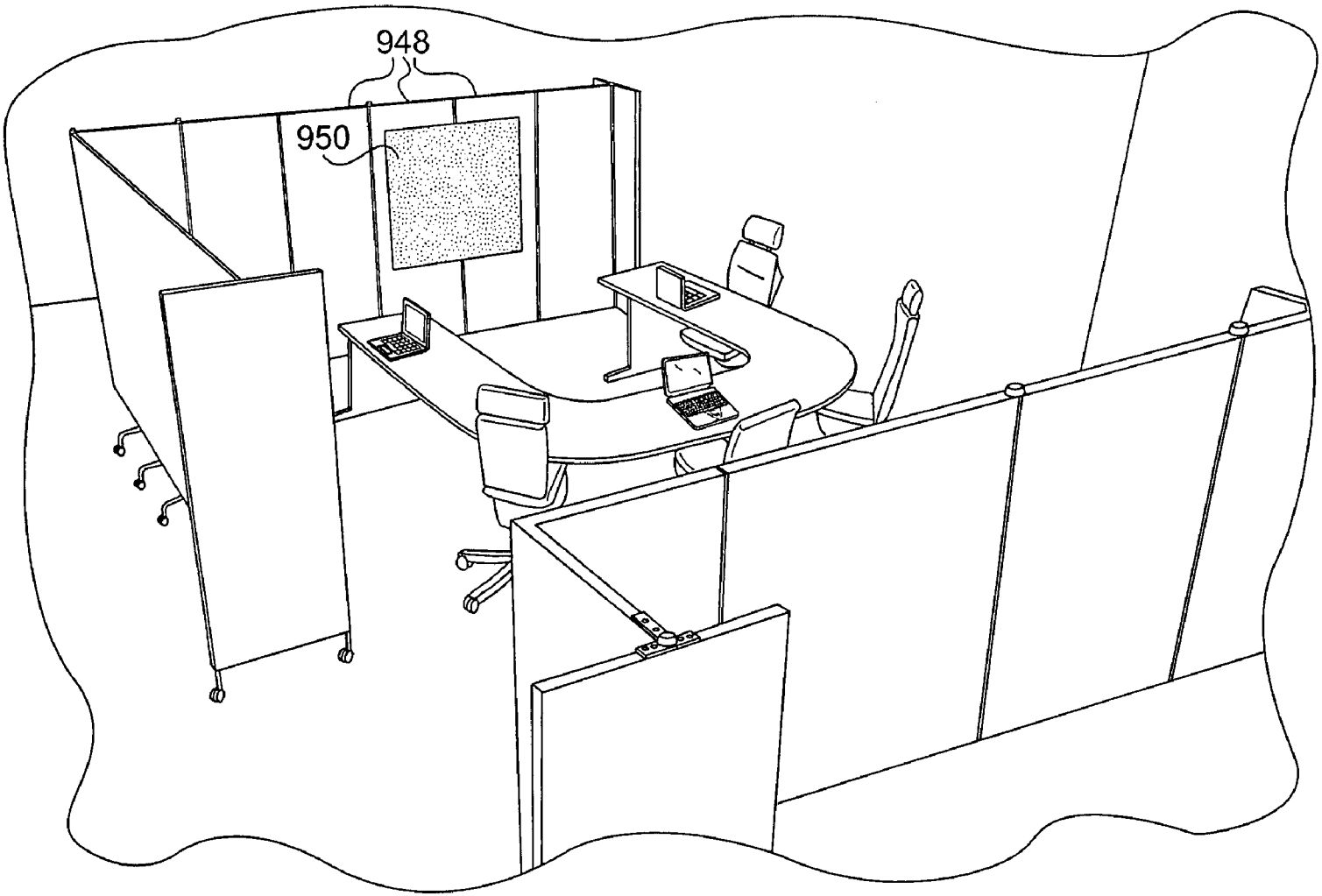
FIG. 12*c* shows a plurality of panels with some of the panels of FIG. 12*a* replaced with tackable panels and with a whiteboard tacked to the tackable panels.

With reference to FIGS. 12*a*, 12*b* and 12*c*, any of the plurality of panels 902 can be replaced with a desired surface such as a general writing surface, i.e., a white board or a black board, or a tacking surface, i.e., such as a cork board, or a tack board. FIG. 12*a* shows the plurality of panels 902 without any of the panels being replaced with a writing surface or a tacking surface. FIG. 12*b* shows the plurality of panels 902 with two of the individual panels 906 removed and replaced with two white board panels 946. FIG. 12*c* shows the plurality of panels 902 with tacking panels 948. Tacking panels 948 allow a smaller whiteboard 950 to be pinned to a planar surface of each of the tacking panels 948.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. For example, one or more elements can be rearranged and/or combined, or additional elements may be added. Thus, the present invention is not intended to be limited to the embodiments shown herein but is to be accorded the widest scope consistent with the principles and novel features disclosed herein. A person having ordinary skill in the art will understand that features from each of the embodiments that are not present in the other embodiments can be added to those embodiments missing the respective features.

We claim:

1. A wall partition comprised of:

a plurality of panels and at least one hinge connecting each of said plurality of panels to an adjoining panel; and a foot on a lower edge of each of said plurality of panels, wherein said foot is comprised of a first extension, a second extension, a respective wheel on a distal end of each of said first extension and said second extension; and wherein said first and said second extensions are connected to each other at a proximal end of each of said first and said second extension to form a vertex;

the foot further comprising a spring located at said vertex, said spring connected at one end to said first extension and connected at an opposite end to said second extension, wherein said spring biases said first and said second extensions toward each other.

2. The wall partition as recited in claim 1 wherein said at least one hinge is comprised of a first arm and a second arm, each of said first arm and said second arm having a semicircular-shaped end, wherein a spring is positioned along a hinge-axis of said hinge such that a spring-axis of said spring is parallel with said hinge-axis and wherein said hinge-axis extends through a center point of each of said first arm and said second arm.

3. The wall partition as recited in claim 2 wherein said semicircular-shaped end of said first arm is separated from said semicircular-shaped end of said second arm by a plurality of ball-bearings.

4. The wall partition as recited in claim 3 wherein said semicircular-shaped end comprises a plurality of recesses.

5. The wall partition as recited in claim 4 wherein said plurality of recesses engageably correspond to said plurality of ball-bearings such that both said plurality of recesses and said plurality of ball-bearings are about equidistant from said hinge-axis.

6. The wall partition as recited in claim 1 wherein each of said plurality of wall-partitions are adapted to be removable from an adjoining wall partition.

7. The wall partition as recited in claim 6 wherein a planar surface of said at least one of said plurality of wall partitions is selected from the group consisting of: a white board, a black board, a cork board, and a tack board.

8. The wall partition as recited in claim 1 wherein a planar surface of said at least one of said plurality of wall partitions is selected from the group consisting of: a white board, a black board, a cork board, and a tack board.

9. A wall partition as recited in claim 8, further comprising at least one secondary panel comprising a plurality of sound absorbing ribs in a first surface thereof.

10. A wall partition comprising:

a plurality of panels;

at least one hinge connecting each of said plurality of panels to an adjoining panel; and a foot on a lower edge of each of said plurality of panels, said foot comprising a first extension, a second extension, a caster on a respective distal end of each of said first extension and said second extension, said caster being swivelable and having wheels, a vertex formed by the connection of said first and said second extensions at a proximal end of each of said first and said second extension, and a spring located proximally to said vertex, said spring connected at one end to said first extension and connected at an opposite end to said second extension, wherein said spring biases said first and said second extensions toward each other.

11. A wall partition comprising:

a plurality of panels;

at least one hinge connecting each of said plurality of panels to an adjoining panel, wherein said at least one hinge is comprised of a first arm, having a semicircular-shaped end, a second arm, having a semicircular-shaped end, a spring positioned along a hinge-axis of said hinge such that a spring-axis of said spring is parallel with a hinge-axis and wherein said hinge-axis extends through a center point of each of said first arm and said second arm, a plurality of ball-bearings separating said semicircular-shaped end of said first arm from said semicircular-shaped end of said second arm, and a plurality of recesses in said semicircular-shaped end of said first arm and said second arm, wherein said plurality of recesses engageably correspond to said plurality of ball-bearings such that both said plurality of recesses and said plurality of ball-bearings are about equidistant from said axis of said hinge; and a foot on a lower edge of each of said plurality of panels, said foot comprising a first extension, a second extension, a caster on a respective distal end of each of said first extension and said second extension, said caster being swivelable and having wheels, a vertex formed by the connection of said first and said second extensions at a proximal end of each of said first and said second extension, and a spring located proximally to said vertex, said spring connected at one end to said first extension and connected at an opposite end to said second extension, wherein said spring biases said first and said second extensions toward each other.

12. The wall partition as recited in claim 1, wherein the first extension and the second extension are pivotally connected to the vertex.

13. The wall partition as recited in claim 10, wherein the first extension and the second extension are pivotally connected to the vertex.

14. The wall partition as recited in claim 11, wherein the first extension and the second extension are pivotally connected to the vertex.

* * * * *